United States Patent [19]

Walker et al.

[11] Patent Number: 4,928,864

[45] Date of Patent: May 29, 1990

[54] HAND CLASP TAPE DISPENSER

[76] Inventors: Jerry Walker; Troy Waddell, both of P.O. Box 1164, Hereford, Tex. 79045

[21] Appl. No.: 234,637

[22] Filed: Aug. 22, 1988

[51] Int. Cl.[5] ..... B26F 3/02

[52] U.S. Cl. ..... 224/162; 224/218; 225/66

[58] Field of Search ..... 224/162, 267, 218, 222; 206/815, 824, 371, 411; 225/42, 46, 66; 242/55.2, 96; 294/25

[56] References Cited

U.S. PATENT DOCUMENTS

| | | | |
|---|---|---|---|
| 2,664,252 | 12/1953 | Glew | 225/66 |
| 3,503,546 | 3/1970 | Hunt | 224/218 |
| 3,907,236 | 9/1975 | Sims, Jr. | 242/85.1 |
| 3,921,936 | 11/1975 | Suter | 242/55.2 |
| 3,980,245 | 9/1976 | Delehoy | 242/55.2 |
| 3,993,230 | 11/1976 | Oakes | 225/47 |
| 4,084,692 | 4/1978 | Bilweis | 206/815 |
| 4,606,485 | 8/1986 | Rankin | 225/66 |

FOREIGN PATENT DOCUMENTS

| | | | |
|---|---|---|---|
| 181755 | 1/1918 | Canada | 224/218 |

*Primary Examiner*—Renee S. Luebke

[57] ABSTRACT

A portable dispenser for dispensing a variety of tape materials which includes a base portion formed as a C-shaped or continuous clamp which is engageable over the back of an individual's hand so as to not interfere with the normal use of the fingers and thumb and which supports a tape supply housing and a cutter assembly which are spaced relative to one another so that a length of tape may be extended from the tape supply housing with the free end thereof positioned adjacent a cutting edge.

8 Claims, 2 Drawing Sheets

HAND CLASP TAPE DISPENSER

FIELD OF THE INVENTION

This invention is generally directed to dispensers for supporting a supply of tape material relative to a cutter so that a desired length of the tape material may be urged from the tape supply and thereafter severed by engaging the tape material with the cutter. More specifically, the present invention is directed to a portable type tape dispenser which is designed to be supported on an individual's hand and which may be easily supported by the person's right or left hand depending upon the dexterity of the individual utilizing the dispensing apparatus without interfering with the normal use of the fingers and thumb.

In one embodiment, the dispenser apparatus of the present invention is provided with a C-shaped base portion which is engageable over the back of a person's hand with the opposing C-shaped ends being disposed along the palm of the hand. In another embodiment, the base portion is formed as a continuous band which is of a size to be selectively seated around a person's hand and between the thumb and index finger. The tape is supported within a housing mounted to a base portion and which housing provides a tape support which is spaced from a cutter. The tape support and cutter are generally aligned vertically with respect to opposite sides of a person's hand so as to provide the maximum and most convenient leverage for severing the tape by relative movement of the hand and tape against the cutter.

In an alternative embodiment of the invention which is particularly adaptable for use with non-adhesive type tapes, ribbons, string, threads and the like, the cutter is mounted or formeded in vertically spaced relationship above an opening in a vertical support which connects the cutter to the base. The opening is formed through the vertical support in order to permit the outermost or free end portion of the tape material to be extended therethrough so as to be easily engageable or grasped to urge the tape material from the dispenser for cutting a desired length of tape by moving the tape upwardly against the cutter. Due to the spacing between the opening and the cutter, a predetermined end portion of the tape will extend through the opening after cutting thereby providing an easily grasped free end of tape for dispensing a subsequent length of tape.

HISTORY OF THE RELATED ART

There are currently many types of tape dispensers, many of which have been designed for specific purposes or to provide special dispensing characteristics. Further, tape dispensers may vary in design or configuration depending upon the type of tape, ribbon, thread, string or the like which is to be dispensed and also to whether or not the material has any adhesive properties.

The most common type of tape dispensers are adhesive tape dispensers which normally include a housing for supporting a spool or roll of adhesive tape in spaced relationship with a cutter. Conventional adhesive tape spools or rolls are manufactured in standardized sizes so as to be adaptable to home and office type dispensers. Therefore, when a roll of adhesive tape is exhausted, a replacement roll may be easily mounted to a dispenser.

As opposed to replacement type dispensers, there are other types of adhesive tape dispensers which are specifically manufactured to be disposed of once a single roll of tape has been dispensed. Such dispensers are normally constructed of a plastic material or combinations of plastic and paperboard or cardboard type material.

Tape dispensers are often awkward to utilize. Many people have experienced the frustration in attempting to wrap a package and hold the edges of the paper while trying to dispense a portion of tape from a tape dispenser. Unfortunately, most conventional adhesive tape dispensers, which are of low cost and available to the average consumer for personal use, require that the dispensing apparatus be held with one hand while the tape is played out and cut utilizing another hand. This means that the package that is being wrapped or the other item which is to be secured utilizing the adhesive tape must be released until the tape has been cut. Further, often, while cutting a length of tape, the cut length of tape folds on itself and adheres to itself thereby necessitating that the tape be pulled apart before it can be utilized. One additional problem with conventional low cost dispensers especially for adhesive and other type of sealing tapes is that the dispenser is not designed to be self-supporting and therefore each time a length of tape is cut, the dispensing apparatus must be placed on a surface and is oftentimes misplaced beneath packages and articles which are being wrapped or sealed utilizing the tape.

The same type of problems occur not only with adhesive type tapes but with dispensers for ribbons and strings which are generally wound on spools from which a length of material may be extended and thereafter severed either utilizing an attached cutting mechanism or a separate pair of scissors. In these situations, both the user's hands must be utilized to dispense the tape and perform the cutting operation prior to utilizing the material to wrap or decorate a package.

To facilitate the dispensing of selected portions of various types of tapes, heavy based dispensers have been designed which theoretically allow the material to be urged from the dispenser without holding the dispenser. Unfortunately, most of such dispensers do not function properly, requiring additional anchoring and additionally, they are expensive and not readily available to the average consumer.

Other types of tape dispensers have been designed to be attached to a garment worn by a person or worn on a person's wrist or fingers. With these types of dispensers, the housing for the tape is anchored relative to the person utilizing the tape and thereby the tape may be played out and severed with the action of one hand. In U.S. Pat. No. 3,993,230 to Oakes, an adhesive tape dispenser is disclosed which is provided with one or more openings through which a person may extend their fingers so as to support the dispenser relative to one hand so that the tape may be played out with the other or opposite hand. With this type of dispenser, it is possible to utilize both hands in cutting the tape. Further, with such dispensers, the tape is always readily available for use as the dispenser does not have to be placed on a separate supporting surface. As discussed in the patent, the structure allows both hands to be utilized to hold or manipulate the tape while simultaneously supporting the tape dispenser. Unfortunately, the structure disclosed requires that the dispenser housing be supported by one or more fingers of a person's hand. Therefore, a person is not free to utilize the total dexterity of the individual fingers to perform tasks such as wrapping, holding or supporting articles relative to the tape dispenser.

With some embodiments of the disclosed invention to Oakes, different dispensers would have to be designed for left and right hand use thereby requiring additional expense in manufacturing and supply of the dispensers. Also, the dispensers are not designed to facilitate the dispensing of non-adhesive type ribbons, threads, strings or tapes. Therefore, the dispensers are limited to specific uses with adhesive type tape materials.

In order to permit a person's hands to be unobstructed during the use of a tape dispenser, other types of dispensers have been designed to be worn about an individual's forearm or wrist. In U.S. Pat. No. 3,921,936 to Sutter, a masking tape dispenser is disclosed which includes a wristlet which fits over the forearm of an individual and from which a stud is mounted so as to support a roll of masking tape relative to the wrist. This type of dispenser, however, provides no cutting element to facilitate the severance of a desired length of tape nor does it provide positive engagement or support of the free end of the tape after a portion has been severed. A similar type of dispenser is disclosed in U.S. Pat. No. 3,980,245 to Delehoy. This type of dispenser also does not provide a separate cutting mechanism and also does not provide for retaining the free end of a tape relative to the dispenser housing during use. Additionally, dispensers which are designed to be mounted to a person's forearm or wrist are too remote from a person's fingers to allow a joint manipulation of two hands to sever the tape and also make it awkward to manipulate the end of the tape with the hands as a long length of material must extend either from the wrist or the forearm.

SUMMARY OF THE INVENTION

This invention is generally directed to a dispensing apparatus which may be mounted over a person's right or left hand and which includes a tape supply housing which extends upwardly above the back hand adjacent one side of the hand and which includes a cutting element which extends upwardly vertically from the opposite side of the hand and also above the back hand. The base of the dispenser includes a C-shaped or continuous band-like mounting element which is resiliently engageable over the back of the hand and extends inwardly from the side of the forehand intermediate the thumb and index finger so as to permit the dispenser to be worn on the hand without interfering with the movement of an individual's thumb or fingers.

In one embodiment of the invention, the base portion of the dispenser may be enlarged so as to cooperatively fit large hands. In this embodiment, the cutting edge may be spaced inwardly of the outer portions of the base so as to be disposed more conveniently spaced relative to the tape supply.

In another embodiment of the invention, an opening is provided beneath the cutting element through which the tape or other material may extend so that the free end of such material is supported at all times relative to the cutter. In this manner, the dispenser may be utilized with both adhesive and non-adhesive type tapes.

It is a primary object of the present invention to provide a low cost tape dispenser which may be utilized to dispense both adhesive and non-adhesive strips of materials from a spool or reel supply and wherein the spool or reel is mounted to a housing supported by a base disposed along the back of a person's hand so that the dispenser is readily available for manipulation by a person's fingers but does not interfere with the movement of the fingers of the hand to which the dispenser is mounted.

It is another object of the present invention to provide a tape dispenser which includes a C-shaped mounting base portion which allows the dispenser to be easily worn over the back of the right or the left hand interchangeably.

It is another object of the present invention to provide a tape dispenser which may be conveniently worn on the back of a person's hand so as not to interfere with the normal movement of the fingers and wherein the tape supply is spaced from the cutter element in such a manner that any force of cutting is equally distributed across the back hand so that when cutting a length of material from the supply, the dispensing unit will not move relative to the person's hand.

It is yet another object of the present invention to provide a tape dispenser which may be positively supported on a person's hand so as to allow the tape supply to be readily available for use and wherein the free end of the tape material may be urged from the supply source and applied to a given area and thereafter severed by a movement of the hand on which the dispenser is mounted so that the free end of the tape is never allowed to fold relative to the severed end of the tape.

It is another object of the present invention to provide a tape dispenser which may be utilized not only to dispense adhesive type tapes but also non-adhesive tapes and other lengths of materials including ribbons, strings, threads, laces, hemming material and the like and wherein the free end of the material is positively supported relative to a supply reel or spool so that the free end will not unravel from the supply spool during the use of the dispenser. Further, in this embodiment, the free end of the material to be dispensed is spaced relative to the cutting edge so that the cutting edge will always sever the material leaving a sufficient amount of free end to insure that the material does not unravel from the supply spool or reel.

BRIEF DESCRIPTION OF THE DRAWINGS

FIG. 3 is a perspective view of a modified embodiment of the dispenser shown in FIG. 1.

FIG. 4 is a perspective view of another embodiment of the invention having a continuous band-like mounting portion.

FIG. 5 is a modified embodiment of the dispenser of FIG. 4.

DESCRIPTION OF THE PREFERRED EMBODIMENT

Figure 1:
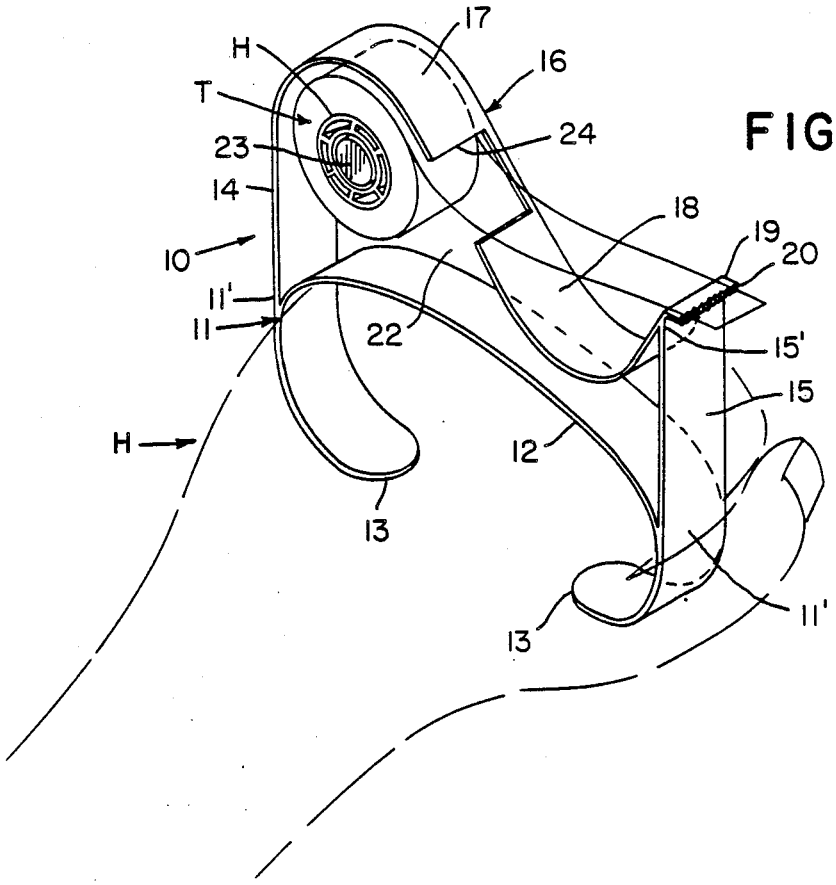
FIG. 1 is a perspective illustrational view of one embodiment of the present invention mounted to an individual's back hand and showing a tape material extending from a spool or reel supply to a cutter.

With continued reference to FIG. 1 of the drawings, the portable tape dispenser 10 is shown in a first embodiment as being worn or secured over the back of a person's hand H. The dispenser includes a generally C-shaped base portion 11 having an upper elongated somewhat arcuate portion 12 which extends along the back of the hand H and a pair of opposing and spaced end portions 13 which are designed to be engageable with the palm of an individual's hand. The dispenser is further provided with a housing which is formed by a pair of vertically extending end-walls 14 and 15 which extend upwardly from the outermost end portions 11' of the base member 11. The housing generally shown at 16 further includes a curvilinear upper wall which is integrally formed and extends between the side walls 14 and 15. The upper wall includes a first convexly upwardly oriented segment 17 and a second concavely oriented segment 18 which has an outer end portion 19 which extends above the uppermost end 15' of the end wall 15. A serrated cutting edge 20 is provided along the outer horizontally oriented portion 19 of the upper wall.

In order to support a supply of tape T which may be in the form of a fixed or disposable spool or reel within the housing 16, each of the forward facing edges of the end walls and upper wall segments 17 and 18 as well as the forward facing edge of the upper portion 12 of base member 11 are interconnected by a side wall 22. A bearing shaft 23 is mounted to the side wall 22 generally centrally beneath the upper arcuate wall segment 17 and provides a support surface for the hub H of the tape reel T. The upper wall is also provided with an open slot 24 which is oriented intermediate the concave upper segment 17 and the concave lower segment 18 and through which the free end of the tape may be extended toward the cutter element 20.

The tape dispenser shown in FIG. 1 is preferably manufactured of a plastic material with the opposing ends of the base portion 11 having resilient properties so that the end portions 13 are yieldable with respect to one another so as to be flexed outwardly. In this manner, the base portion may be adapted to resiliently or clampingly engage hands of varying sizes. As previously discussed, it is one of the purposes of the invention to provide a tape dispenser which is yieldably secured to the back of a person's hand so that the fingers and thumb are free to be utilized in a normal manner and without interference with the dispenser. Therefore, it is preferred that the base portion have such resilient characteristics. The remaining portions including the end walls 14 and 15, upper wall segments 17 and 18 and side wall 22 may be formed of a more rigid plastic material or have more rigid characteristics.

As previously discussed, the dispenser may be designed to accept replaceable rolls of tape T or may be designed to be sold with a single roll of tape with the entire dispenser being disposable upon the complete dispensing of the roll of tape from the tape support spool 23.

The tape dispenser shown in FIG. 1 is particularly adapted for use with adhesive tapes which may have adhesive placed either along the lower surface of the tape or along both the upper and lower surfaces. In use, once a roll or reel of tape T is placed over the support shaft 23, a free end of tape is extended through the opened slot 24 formed in the upper wall between wall segments 17 and 18 with the outermost end portion thereof adhesively secured to the outermost end portion 19 of the dispenser. The dispenser is thereafter placed in mounted relationship over the back hand of an individual with the C-shaped mounting portion engaging the outer portion of the hand and curving between the thumb and forefinger so that the end portions 13 face one another along the palm of the hand. As the base portion is formed of a resilient material, the ends 13 will clampingly secure the dispenser to the hand leaving the fingers and thumb free for normal manipulation. When it is desired to use a length of tape, the outermost edge of the free end of the tape is lifted and the tape pulled from the tape spool. Thereafter, the tape is brought downwardly toward the cutter 20. As the tape is being urged toward the cutter 20, a short segment thereof will engage the generally planar surface of the outer end portion 19 so as to be secured thereto, and, with a rotational movement of the hand on which the dispenser is mounted, the tape is quickly severed. In instances where a person is utilizing both hands to manipulate a wrapping material or other elements which are to be sealed or closed utilizing the tape, the free end of the tape may be initially placed along one portion of the material being joined before the tape is severed. The hand with the dispenser mounted thereto is then pulled along the line to be sealed by the tape and thereafter the hand twisted to cut the tape. In this manner, the portion of tape being dispensed is not free to fold upon itself and therefore there is no wasted tape or wasted time and inconvenience associated with the use of the tape utilizing the dispenser of the present invention.

Figure 2:
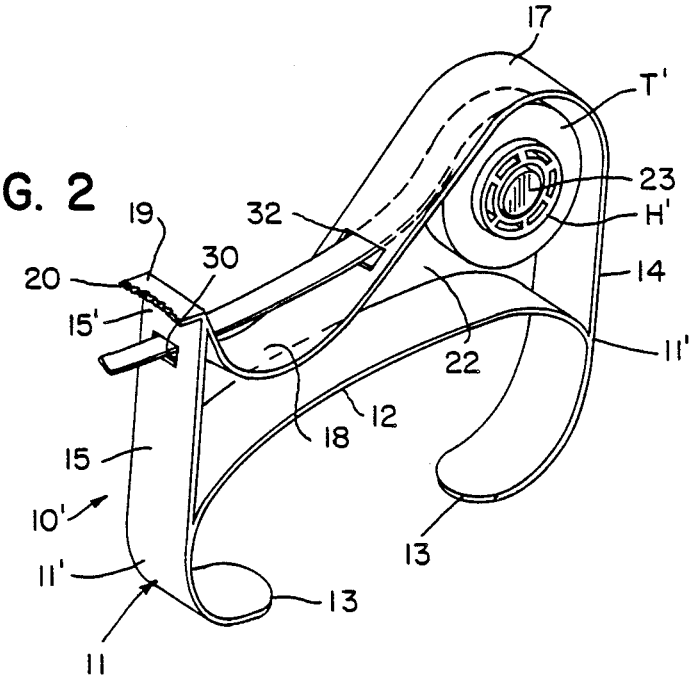
FIG. 2 is a perspective illustrational view of a second embodiment of the present invention showing a tape material extending through an opening spaced relative to the cutter so as to provide a positive support for the free end of the tape material.

As previously discussed, the invention is also designed to be utilized with non-adhesive type tapes, ribbons, string, threads, laces, hemming materials and the like. A modified form of the present invention is shown in FIG. 2. In this embodiment, the like or common elements of the two embodiments are shown with the same reference numbers. It should be noted that in this embodiment, the side wall 22 is oriented on an opposite leading edge of the base member portion 12, end walls 14 and 15 and upper wall segments 17 and 18. The side wall 22 may be similarly placed in the embodiment of FIG. 1. Further, a pair of opposing side walls 22 may be utilized in either embodiment without changing the operational and functional effectiveness of the present invention.

In the embodiment of the invention shown in FIG. 2 which is identified as 10', the primary modification is made by providing an opening 30 in the end wall 15 in a location spaced below the cutting edge 20. Further, in order to provide increased support for the free end of the tape relative to the dispenser, the slot or recess 24 may be enclosed to form an opening 32 in the upper wall intermediate the wall segments 17 and 18. Also, in some instances, an opening (not shown) may be required through the upper wall segment 18 so as to align with the opening 32.

In the use of the embodiment of invention shown in FIG. 2, a supply of tape, which may be a non-adhesive type tape such as a ribbon material or the like, shown at T' having a hub portion H' is mounted over the support shaft 23. Thereafter, the free end thereof is extended through the openings 32 and 30 wherein the free end of the tape material is supported relative to the tape supply spool. After the tape has been mounted to the dispenser, the dispenser is mounted on the back of a person's hand in the same manner as discussed above with respect to the embodiment of FIG. 1. As with the first embodiment, the dispenser is designed to be worn interchangeably on a person's left or right hand by simply reversing the direction in which the side wall 22 faces. When it is desired to dispense a length of tape, the outermost portion of the free end of tape is urged outwardly of the opening 30 and is thereafter cut by simultaneously lifting the tape towards the cutter and rotating the hand so as to bring the cutter toward the tape. Once the tape is severed, a segment of tape will remain extended through the opening 30 due to its vertically spaced relationship with respect to the cutting edge 20. The length of tape extending through the opening 30 may be varied depending upon the vertical spacing between the cutter edge 20 and the opening 30. It is important to insure that a sufficient length of tape extend outwardly of opening 30 so that the tape will not collapse or pass inwardly of the opening after each section of tape has been severed from the dispenser.

With particular reference to FIG. 3 of the drawings, a modified embodiment of the dispenser of FIG. 1 is shown in detail. In this embodiment, the base portion 11 of the dispensing apparatus is enlarged so that the dispenser may be cooperatively utilized by a person having large hands. In this embodiment, the end wall 15 which extends vertically upward to the cutting edge 20 is spaced inwardly of the outer end portion 11' of the C-shaped mounting portion. In this manner, the cutting edge 20 is retained at approximately the same spaced distance from the tape reel T as is the cutting edge 20 of the embodiment of FIG. 1. The spacing of the cutting edge relative to the tape reel is designed to permit a sufficient extension of tape to be urged forwardly of the tape reel but without allowing the tape to fall into contact with the upper wall 18 of the dispensing apparatus causing premature adhesion of the tape to the upper wall in those instances where adhesive tape is being dispensed.

With respect to FIGS. 4 and 5 of the drawings, another embodiment of the invention is disclosed in greater detail. In these embodiments, the mounting portion of the dispenser is formed as a continuous band element shown as 40 in FIG. 4 and 40' in FIG. 5. The band elements are designed to be cooperatively engageable encircling a person's hand while extending inwardly between the thumb and forefinger. In FIG. 4, the band is formed slightly smaller than the band 40' of FIG. 5. The bands include upper and lower portions 41 and 42 and 41' and 42', respectively. The housing portion of each of the embodiments shown in FIGS. 4 and 5 and as identified at 16 is essentially the same as that of the previous embodiments.

We claim:

1. A tape dispenser for selectively severing a free end of tape from a tape supply reel and which dispenser is worn along the back, sides and palm of an individual's hand so as to extend between the thumb and forefinger comprising a base member, said base member including an intermediate arcuate portion and spaced opposing outermost portions, said base member being of a size to at least extend along the back and sides of an individual's hand with said intermediate portion being generally continuously engageable with the back of an individual's hand, a housing mounted to said base member and extending outwardly with respect to said intermediate portion thereof, said housing including a pair of spaced end walls, a tape supply reel support means carried by said housing adjacent one of said end walls, and a cutter means spaced from said tape supply reel support means and adjacent the other of said end walls whereby said dispenser may be positioned about an individual's hand so that the housing extends from the back of the individual's hand so that the thumb and fingers are free for normal manipulation.

2. The tape dispenser of claim 1 in which said end walls extend outwardly from adjacent said outermost portions of said base member, said other of said end walls having an outer end, said cutter means extending outwardly with respect to said outer end of said other of said end walls.

3. The tape dispenser of claim 2 in which said housing includes an upper wall portion having first and second curvilinear segments, said first segment having a convex configuration and said second portion having a concave configuration, said first and second segments being spaced by a slot through which the free end of the tape extends towards said cutter means.

4. The tape dispenser of claim 3 including an opening in said other of said end walls, said opening being oriented in spaced relationship with respect to said cutter means, the free end of the tape being extendable through said opening so as to be supported therethrough whereby when a portion of the free end of the tape is severed from said supply reel by said cutter means, a predesignated length of the free end will remain outwardly of said opening due to the spacing between said opening and said cutter means.

5. The tape dispenser of claim 1 in which said base member is a generally C-shaped member having spaced free ends, said spaced free ends being yieldable with respect to one another.

6. The tape dispenser of claim 5 including a first opening in said other of said end walls, said opening being oriented in spaced relationship with respect to said cutter means, the free end of the tape being extendable through said opening so as to be supported therethrough whereby when a portion of the free end of the tape is severed from said supply reel by said cutter means, a predesignated length of the free end will remain outwardly of said opening due to the spacing between said opening and said cutter means.

7. The tape dispenser of claim 6 in which said housing includes an upper wall portion having first and second curvilinear segments, said first segment having a convex configuration and said second portion having concave configuration, a second opening in said upper wall of said housing, said second opening being defined between said first and second segments, the free end of the tape passing through said first and second openings toward said outer means.

8. The tape dispenser of claim 7 in which said end walls extend from adjacent the outermost portions of said base member, said other of said end walls having an outermost end, and said cutter means extending from said outermost end of said other of said end walls.

* * * * *